US008342794B2

(12) United States Patent
Staroselsky et al.

(10) Patent No.: US 8,342,794 B2
(45) Date of Patent: Jan. 1, 2013

(54) STALL AND SURGE DETECTION SYSTEM AND METHOD

(75) Inventors: Serge Staroselsky, Ft. Collins, CO (US); William Charles Jost, Minden, NV (US); Mel Gabriel Maalouf, Minden, NV (US); Andriy Andreyev, Ft. Collins, CO (US); Michael Tolmatsky, Ft. Collins, CO (US)

(73) Assignee: General Electric Company, Schenectady, NY (US)

( * ) Notice: Subject to any disclaimer, the term of this patent is extended or adjusted under 35 U.S.C. 154(b) by 879 days.

(21) Appl. No.: 12/468,759

(22) Filed: May 19, 2009

(65) Prior Publication Data

US 2010/0296914 A1 Nov. 25, 2010

(51) Int. Cl.
*F04D 27/02* (2006.01)

(52) U.S. Cl. ..... 415/17

(58) Field of Classification Search ..... None
See application file for complete search history.

(56) References Cited

U.S. PATENT DOCUMENTS

| | | | | |
|---|---|---|---|---|
| 4,363,596 | A | 12/1982 | Watson et al. | |
| 4,831,534 | A * | 5/1989 | Blotenberg | 701/100 |
| 4,949,276 | A * | 8/1990 | Staroselsky et al. | 701/100 |
| 5,224,452 | A | 7/1993 | Tomizawa | |
| 5,437,539 | A * | 8/1995 | Gysling et al. | 415/68 |
| 5,913,248 | A | 6/1999 | Harada et al. | |
| 6,354,806 | B1 | 3/2002 | Bingham, Jr. | |

OTHER PUBLICATIONS

Don E. Bently and Paul Goldman, "Vibrational Diagnostics of Rotating Stall in Centrifugal Compressors," ORBIT Magazine, First Quarter 2000, pp. 32-40.

D. Fred Marshall and James M. Sorokes, "A Review of Aerodynamically Induced Forces Acting on Centrifugal Compressors, and Resulting Vibration Characteristics of Rotors," Proceedings of the 29th Turbomachinery Symposium, Sep. 2000.

* cited by examiner

*Primary Examiner* — Richard Edgar
(74) *Attorney, Agent, or Firm* — Fletcher Yoder P.C.

(57) ABSTRACT

A system includes a compressor and a control system. The control system includes a processor and associated memory. The control system is configured to receive feedback comprising a thermodynamic characteristic or a mechanical characteristic of the compressor. Also, the control system is configured to generate an indication of a surge event or a stall event in the compressor based on the feedback.

20 Claims, 9 Drawing Sheets

STALL AND SURGE DETECTION SYSTEM AND METHOD

BACKGROUND OF THE INVENTION

The subject matter disclosed herein relates to rotating stall, incipient surge, and surge detection in a compression system, e.g., in an industrial centrifugal or axial compressor, or a gas turbine engine.

As compressors operate, performance of the compressor and associated process and equipment may be adversely affected by disruptive events in the compressor and interaction between performance characteristics of the compressor and other elements of the system. Examples of these disruptive events include surge, incipient surge and rotating stall events in the compression system. Surge can be described as large and self-sustaining pressure and flow oscillations in the compression system, resulting from the interaction between the characteristics of the compressor and those of surrounding equipment. This includes associated piping, vessels, valves, coolers, and any other equipment affecting the pressure, temperature, gas composition, and flow in the compressor. Other compressor parameters, such as rotating speed, consumed power or motor current will also be affected, because pressure and flow oscillations result in significant changes in the power consumed by the compressor. Stall, e.g., rotating stall, and incipient surge occur as the flow through the compressor is reduced to a point where flow distortions appear around the rotating and non-rotating components of the compressor, due to boundary layer separation, blocking part or all of the flow between, for example, two adjacent compressor blades. Stall can further lead to blockage of significant parts of compressor gas passages, thus severely altering performance characteristics of the compressor. Severe stall may result in significant pressure-flow pulsations that may be referred to as incipient surge. Rotating stall and incipient surge may lead to full compressor surge, with flow reversal through the compressor, however full surge may occur without noticeable advent of rotating stall, or incipient surge, or the two may occur simultaneously.

Thus, surge and stall events can be extremely disruptive to any process or equipment having a compression system, such as a refining or a chemical process, or turbine engine driving a generator in a power plant. Accordingly, accurate detection of these events and protection from these events based on the detection may operate to extend the life and increase intervals between outages of the compression equipment and associated process.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a monitor system configured to receive measurements indicative of operational, thermodynamic, and mechanical characteristics of a compressor, and to generate a compressor stability indication based on the thermodynamic and mechanical characteristics, and a control system configured to receive the compressor stability indication and to generate a response to the compressor stability indication.

In a second embodiment, an system includes a compressor, a thermodynamic and mechanical monitor system configured to receive measurements indicative of a thermodynamic characteristic and a mechanical characteristic of the compressor and to generate an indication of a surge event and a stall event in the compressor based on the thermodynamic and mechanical characteristics, and a control system configured to receive the indication of surge and stall events and to generate a response to the indication of surge and stall events.

In a third embodiment, a system includes a compressor, and a control system comprising a processor and associated memory, wherein the control system is configured to receive feedback comprising a thermodynamic characteristic or a mechanical characteristic of the compressor, and the control system is configured to generate an indication of a surge event or a stall event in the compressor based on the feedback.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The disclosed embodiments are directed to a system and method to detect and to subsequently avoid the onset of incipient surge, stall and surge events in a centrifugal or axial compressor. This may be accomplished through the monitoring of mechanical and/or thermodynamic parameters of the compressor. Furthermore, real-time adjustments, for example, on the order of milliseconds, may be made to the compressor control system to protect from and avoid any surge and stall events. Additionally, operating limits of the compressor may be adjusted in real-time and may be displayed for analysis on a real-time compressor map.

Figure 1:
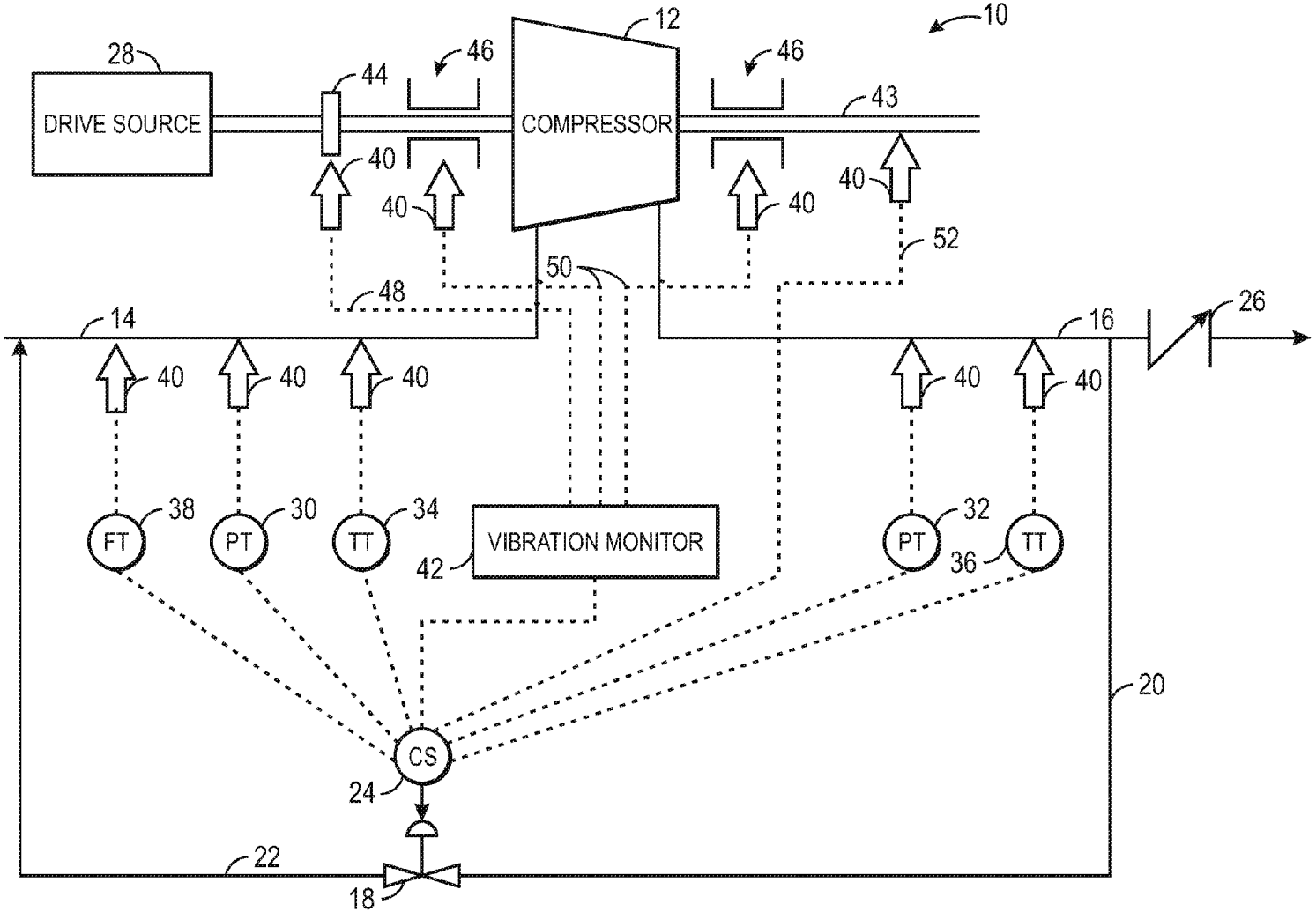
FIG. 1 is a block diagram of an embodiment of a compression system having monitoring and control systems in accordance with an embodiment of the present technique.

Turning now to the drawings and referring first to FIG. 1, illustrating a compression system 10 applicable to processes in refining, petrochemical and other industrial applications. The compression system 10 may include a compressor 12, which may be a centrifugal or axial compressor, as well as associated piping 14 and 16. The compressor 10 may operate to compress a fluid, for example, gas from a source (e.g., a gas pipeline) via inlet piping 14. The compressed fluid may then be outputted from the compressor 12 via discharge piping 16 for further processing or other required usage. The compression system may utilize a recycle valve 18, as well as associated piping 20 and 22 for protecting the compressor from surge by recycling all or part of flow from the compressor 12 discharge along piping 16 and 20 back to the suction side of the compressor 12 via piping 22 and 14. This recycling may be regulated by, for example, the control system 24 opening the recycle valve 18 to allow high pressure fluid received from piping 20 to be transmitted to piping 22 and 14 to be transmitted into the suction side of the compressor 12. In this manner, the pressure of the fluid in piping 14 may be adjusted prior to the fluid entering the compressor 12 such that conditions conducive to either a stall or a surge may be reduced and/or eliminated. It should also be noted that piping 16 is coupled to a non-return valve 26 that may facilitate antisurge protection by preventing reverse flow through the compressor 12 from downstream piping and vessels.

As described above, the recycle valve 18 is manipulated by the control system 24. Control system 24 provides antisurge protection for the compressor 12. Control system 24 may also provide other control functions (e.g., speed regulation of the driver) for the entire compression system 10 (e.g. a turbomachinery train or unit) including the compressor 12, its drive source 28, as well as other auxiliary equipment. The control system 24 may include an antisurge controller that monitors thermodynamic parameters of the compressor 12 through suction and discharge pressure measurements via one or more measurement devices. An example of these measurement devices is a suction pressure measurement device 30 (such as a pressure transmitter) and a discharge pressure measurement device 32 (such as a pressure transmitter). The antisurge controller may also monitor thermodynamic parameters of the compressor 12 through suction discharge temperature measurements via measurement devices, such as a suction temperature measurement device 34 and a discharge temperature measurement device 36. Additionally, the antisurge controller may monitor thermodynamic parameters of the compressor 12 through flow measurements via a follow measurement device 38. Each of the measurement devices 30 through 38 may convert a received signal from a sensor 40 coupled to their respective transmitter into an electronic signal that may be transmitted to the control system 24 for processing.

Antisurge controller of the control system 24 may also contain settings, which define a Surge Limit Line (SLL) and a Surge Control Line (SCL). The SLL defines the onset of surge in terms of compressor flow and head and may be defined as flow at surge as a function of compressor head, as may be seen in FIG. 3. The SCL is offset from the SLL by a suitable flow margin and defines the safe operating limit of the compressor 12 in the low flow region, whereby the flow margin provides the amount of time for the antisurge controller to open the recycle valve 18 so as to prevent the compressor operating point from crossing the SLL.

Additionally, the system 10 is equipped with a vibration monitor 42. Vibration monitor 42 may acquire measurements from the radial vibration and axial vibration and displacement sensors 40 and provide condition signals to the control system 24 to avoid, eliminate, or generally prevent a compressor stall or surge condition associated with the compressor 12, in conjunction with the thermodynamic measurements, received directly by control system 24. Thus, the vibration monitor 42 may be part of a monitor system that generates a compressor stability indication based on the thermodynamic and mechanical characteristics described above. The sensors 40 may include proximity sensors 40 attached to the bearings of drive shaft 43 of the compressor system 10. A thrust bearing 44 as well as one or more radial bearings 46, are illustrated along drive shaft 43. The thrust bearing 44 may, for example, include one or more special pads, or discs, that may abut the drive shaft 43. The thrust bearing 44, for example, may be a rotary type bearing that permits the rotation of the drive shaft 43 freely, as well as supports the axial load of the drive shaft 43. Additionally, the radial bearings 46 may provide for rotational movement of the drive shaft 43 freely, however, unlike the thrust bearing 44, the radial bearings 46 may not be called upon to support the axial load of the drive shaft 43, but may support the weight of the shaft. In conjunction, the thrust bearing 44 and the radial bearings 46 may allow for some radial movement of the drive shaft 43 while substantially restricting axial movement of the drive shaft 43.

The sensors 40 may, for example, register axial displacement in the thrust bearing 44 which may be transmitted along measurement line 48 to the vibration monitor 42. That is, sensor 40 may register position, movement or vibration in the axial direction of the drive shaft 43 for transmission across measurement line 48. Similarly, the radial bearings 46 may have sensors 40 attached thereto. The sensors 40 for the radial bearings 46 may be coupled to measurement lines 50 for transmission of radial vibration signals and position of the drive shaft 43 to the vibration monitor 42. The vibration monitor 42, or the control system 24 itself, may also receive a signal proportional the rotating speed of the shaft 43 across measurement line 52.

The vibration monitor 42 may be used to provide condition signals to trigger corrective actions by the control system 24. For example, the control system 24 may take appropriate action based on the condition signals, such as opening the recycle valve 18 to reduce pressure differential across the compressor 12 and thus move the operating point of the compressor 12 away from surge condition. As discussed in detail below, the disclosed embodiments may employ a combination of both thermodynamic and vibration measurements to identify or predict a compressor stall or surge condition, and then take corrective actions via the control system 24.

Figure 2:
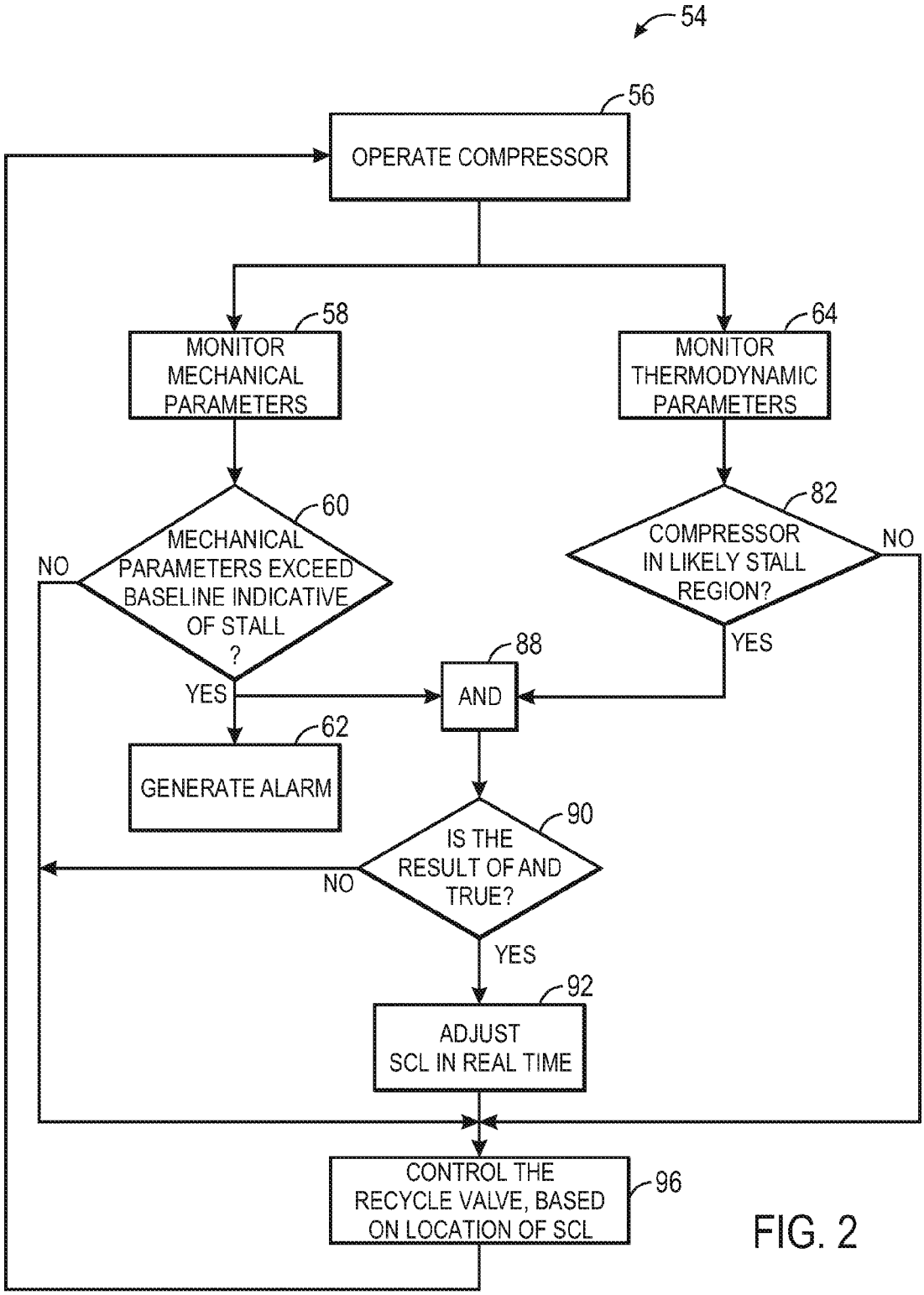
FIG. 2 is a flow chart of an embodiment of the operation of the monitoring and control systems of FIG. 1 with respect to detection of rotating stall and incipient surge in accordance with an embodiment of the present technique.

FIG. 2 illustrates a flow chart detailing a process 54 for operating a compressor 12 in conjunction with the monitor system 42 and the control system 24 to detect and correct rotating stall and/or incipient surge in the compressor 12. In step 56 of process 54, compressor 12 compresses gas for use in a downstream process. As the gas is compressed in the compressor 12, the sensors 40 adjacent to compressor 12 may monitor the mechanical parameters of the compressor 120 in step 58. These mechanical parameters may include, for example, axial displacement and vibration of the drive shaft 43, and/or radial vibration and position of the drive shaft 43 with respect to the compressor 12. These mechanical parameters may be monitored by sensors 40 and transmitted across measurement lines 48 and 50 to the vibration monitor 42. The vibration monitor 42 may determine if one or more of the measured mechanical parameters described above exceeds a base line value in step 60. This base line value may be indicative of, for example, a stall (e.g., a stall or incipient surge) in the compressor 12. As described above, a rotating stall may occur as the flow through the compressor 12 is reduced to a point where flow distortions appear in the flow path of the internal components of the compressor 12. The rotating stall may, for example, inhibit part or all of the flow between, impeller blades or diffuser vanes of the compressor 12. Rotating stall may also produce unbalanced radial forces on the rotor of the compressor 12, which manifest themselves through the appearance of significant components of radial vibration signals at frequencies other than the rotating frequency of the compressor 12. Vibration monitor 42 generates a signal when such components exceed a baseline threshold value and communicates this signal to the control system 24, such that an alarm may be sounded in step 62.

Figure 3:
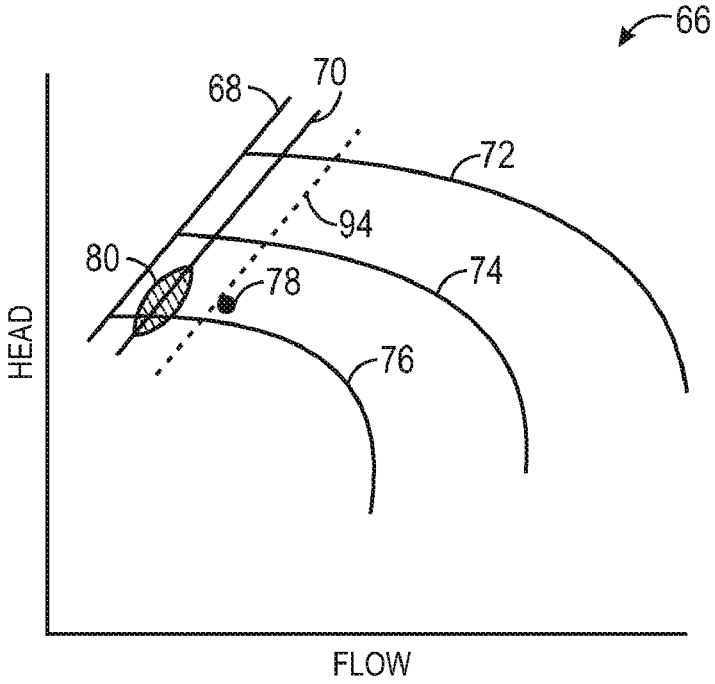
FIG. 3 is a graphic illustration of an embodiment of an operational map of the compression system of FIG. 1, in accordance with an embodiment of the present technique.

Control system 24 also monitors thermodynamic parameters such as flow, pressure, and temperature in the compressor 12 in step 64 and calculates the location of the operating point of the compressor 12 relative to the Surge Control Line (SCL) or Surge Limit Line (SLL), illustrated in FIG. 3. FIG. 3 illustrates a typical compressor map 66, of Flow (fluid flow through the compressor 12 in, for example, feet per second) vs. head (e.g. pressure differential across the compressor 12 in, for example, pounds per square inch). The compressor map 66 shows the location of the SLL 68, SCL 70, compressor performance curves 72, 74, and 76, the operating point 78 of the compressor 12, as well as a region 80 in which stall or surge is detected. The SLL 68 may represent a flow limit whereby when the flow through the compressor 12 decreases below this flow limit, operation of the compressor 12 becomes unstable. The SLL 68 may be given as function of the pressure ratio or head of the compressor 12, for example. The SLL 68 may be set by the manufacturer of the compressor 12, or it may be set based on tests conducted in the field. The SCL may also be set based on field testing of the compressor 12 and control system 24. Depending on the coordinates in which the compressor map 66 is viewed, the actual surge limit, (e.g. the values on the operational curves 72, 74, and 76 at which the flow limit is reached), is not constant in operation, but rather varies depending on the operating conditions of the compressor 12, such as inlet pressure, temperature, and the type of gas that is being compressed. Additionally, SLL 68 may shift due to degradation of the compressor 12 over time, or certain failures, which may cause foreign objects or matter to obstruct or otherwise change gas flow through the compressor 12.

Figure 4:
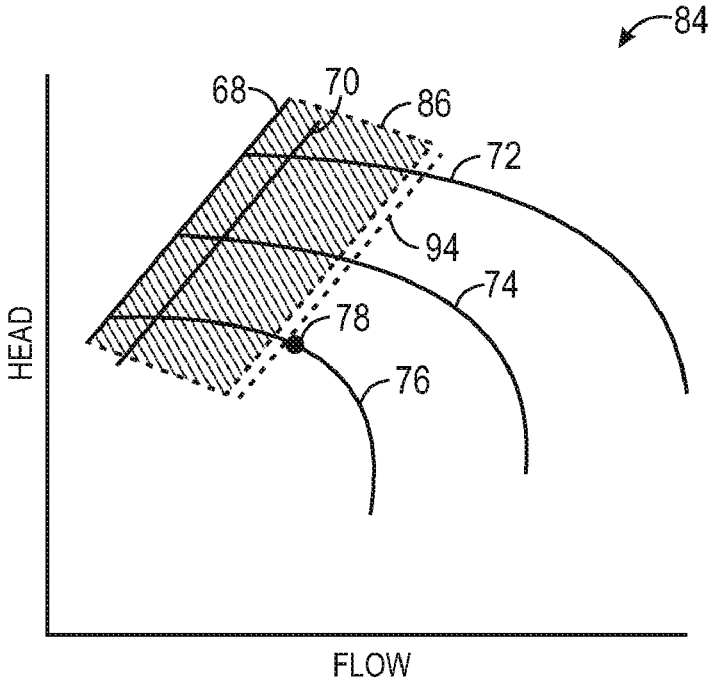
FIG. 4 is a graphic illustration of an embodiment of an operational map of the compression system of FIG. 1 showing likely stall region, in accordance with an embodiment of the present technique.

Returning again to FIG. 2, the control system 24, in step 82, determines if the operating point 78 is in the region of the compressor map 66 where a rotating stall condition is likely to occur. For example, since rotating stall is likely to occur in the vicinity of the SLL 68, the boundary of such a region may be determined by its distance from the SLL 68. FIG. 4 illustrates a compressor map 84 that includes a SLL 68, a SCL 70, compressor performance curves 72, 74, and 76, an operating point 78 of the compressor 12, as well as a region 86 in which stall is likely to occur.

Thus, in steps 88 and 90, if both the operating point 78 of the compressor 12 is in the region 86 marked as likely stall region, and if control system 24 receives a rotating stall indication from the vibration monitor 42, then the process 54 may proceed to step 92 to adjust in real-time the location of the SCL 70 to position 94 in FIGS. 3 and 4. Movement of the SCL 70 may operate as a governor to avoid the compressor 12 from operating in the rotating stall region 80. As a consequence of increased margin between the SLL 68 and new SCL position 94, the control system 24 may cause the recycle valve 18 to be opened to change the pressure and flow characteristics in the compressor 12, thereby avoiding or eliminating the rotating stall condition.

If, however, the measured mechanical parameters do not exceed baseline value indicative of rotating stall in step 60, or the distance of the operating point to the SLL 68 exceeds baseline threshold value in step 82, the process 48 may proceed to directly to step 96, whereby the control system 24 will protect the compressor 12 based on the original setting of the SCL 70.

Figure 5:
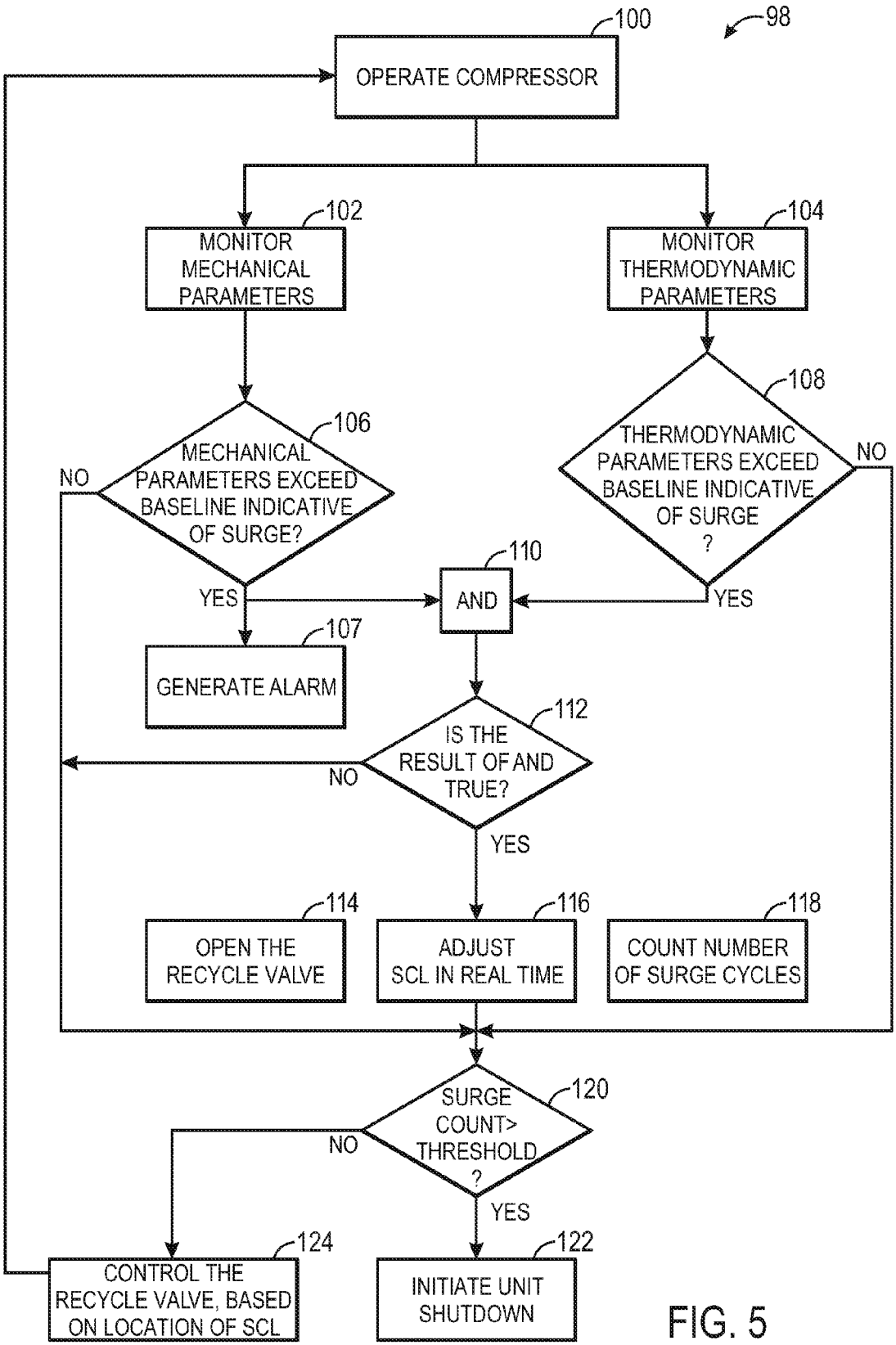
FIG. 5 is a flow chart of an embodiment of the operation of the monitoring and control systems of FIG. 1 with respect to detection of surge in accordance with an embodiment of the present technique.

Concurrently with process 54 described above with respect to FIG. 2 for rotating stall detection, a process 98 for surge detection may be implemented as shown in FIG. 5. Surge may cause large fluctuations in the pressure differential and flow across the compressor 12, which in turn, cause the axial forces on the compressor shaft 43 to change rapidly. In step 100 of process 98, compressor 12 compresses gas for use in a downstream process. In step 102, the vibration monitor 42 determines if the measured mechanical parameters, namely, axial displacement and vibration, transmitted across measurement lines 48 and 50 from sensors 40, exceed a base line value indicative of a surge. Simultaneously, control system 24 monitors thermodynamic characteristics of the compression system 10, such as flow and pressure in the compressor 12, and calculates the rates-of-change of these parameters in step 104. If both the mechanical indication in step 106 (generating an alarm in step 107) and the thermodynamic indication of surge in step 108 are present in steps 110 and 112, the control system 24 opens the recycle valve 18 to stop surge in step 114, increments the SCL 70 margin in step 116, and increments a surge counter in step 118. If surge counter exceeds selected threshold value in certain time period (e.g., approximately 5, 10, 15, or 20 sec) in step 120, the control system 24 may initiate a system 10 shutdown in step 122. Otherwise, control system 24 will continue to operate the system 10 via step 124, that is, by controlling the recycle valve 18 according to the location of the SCL 70. Additionally, if the measured values transmitted across measurement lines 48 and 50 in steps 106 and 108 do not exceed a base line threshold indicative of a surge in the compressor 12, then the process 98 may continue directly to step 120.

Figure 6:
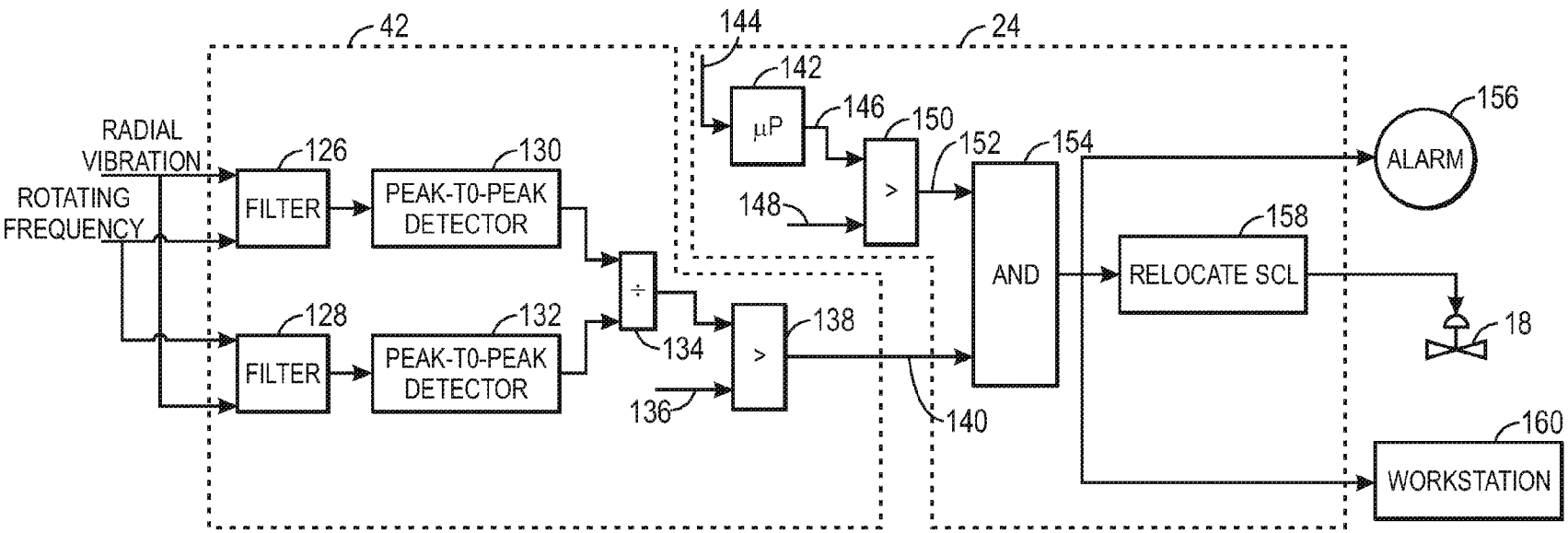
FIG. 6 is a block diagram of an embodiment of methodology of rotating stall and incipient surge detection, applicable to the compression system of FIG. 1, in accordance with an embodiment of the present technique.
Figure 7:
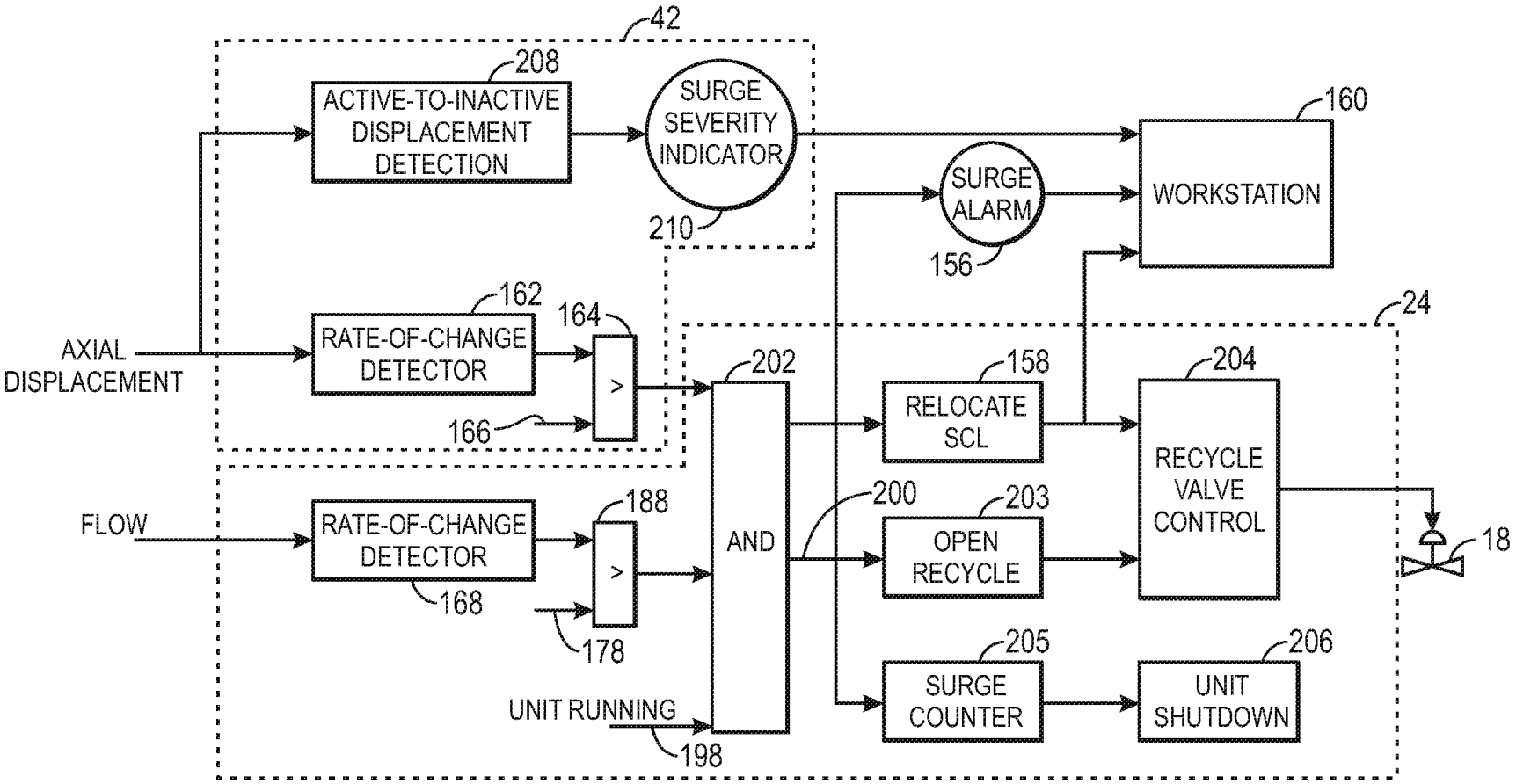
FIG. 7 is a block diagram of an embodiment of methodology for surge detection utilizing axial displacement and flow signals, applicable to the compression system of FIG. 1, in accordance with an embodiment of the present technique.
Figure 8:
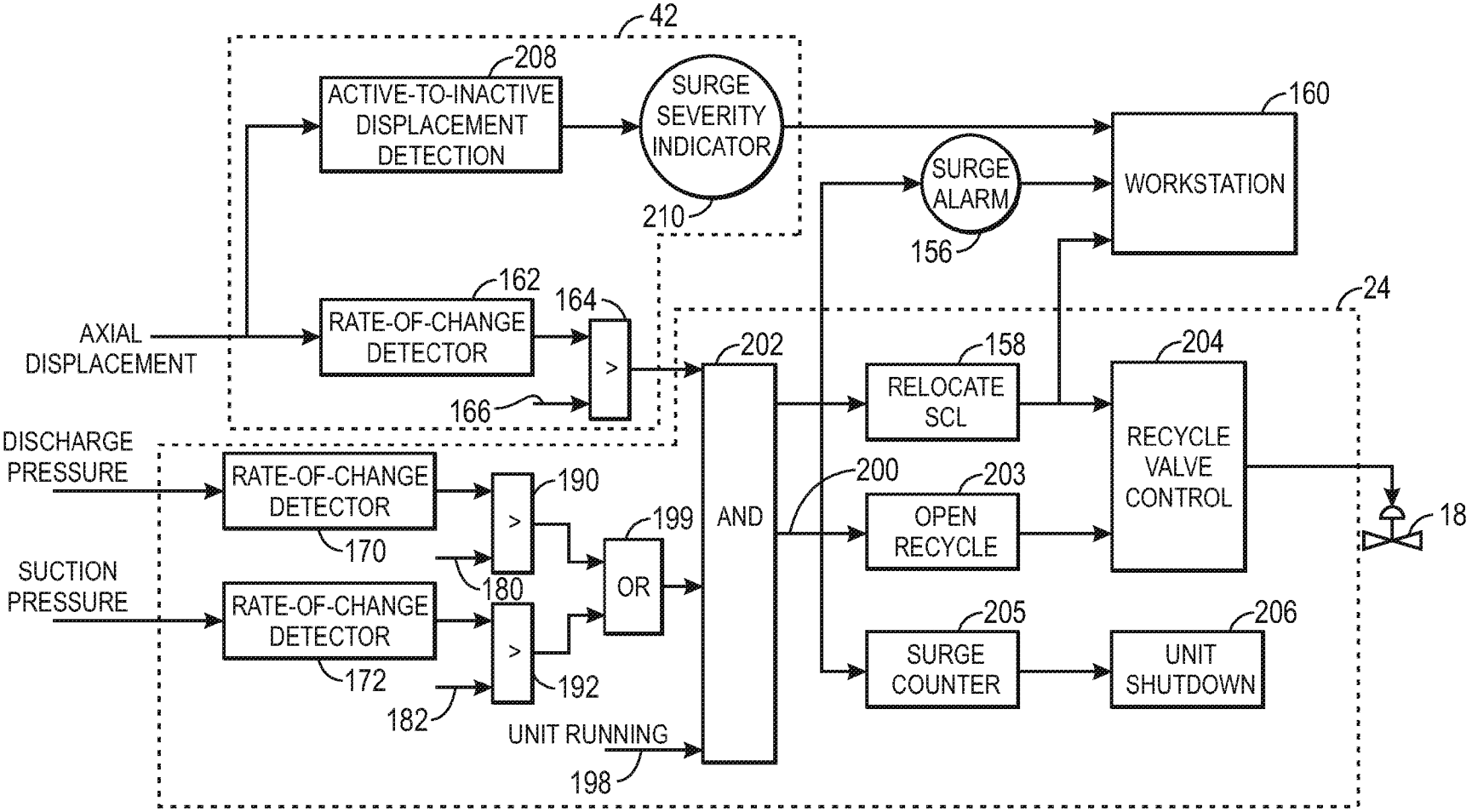
FIG. 8 is a block diagram of an embodiment of methodology for surge detection utilizing axial displacement and pressure signals, applicable to the compression system of FIG. 1, in accordance with an embodiment of the present technique.
Figure 9:
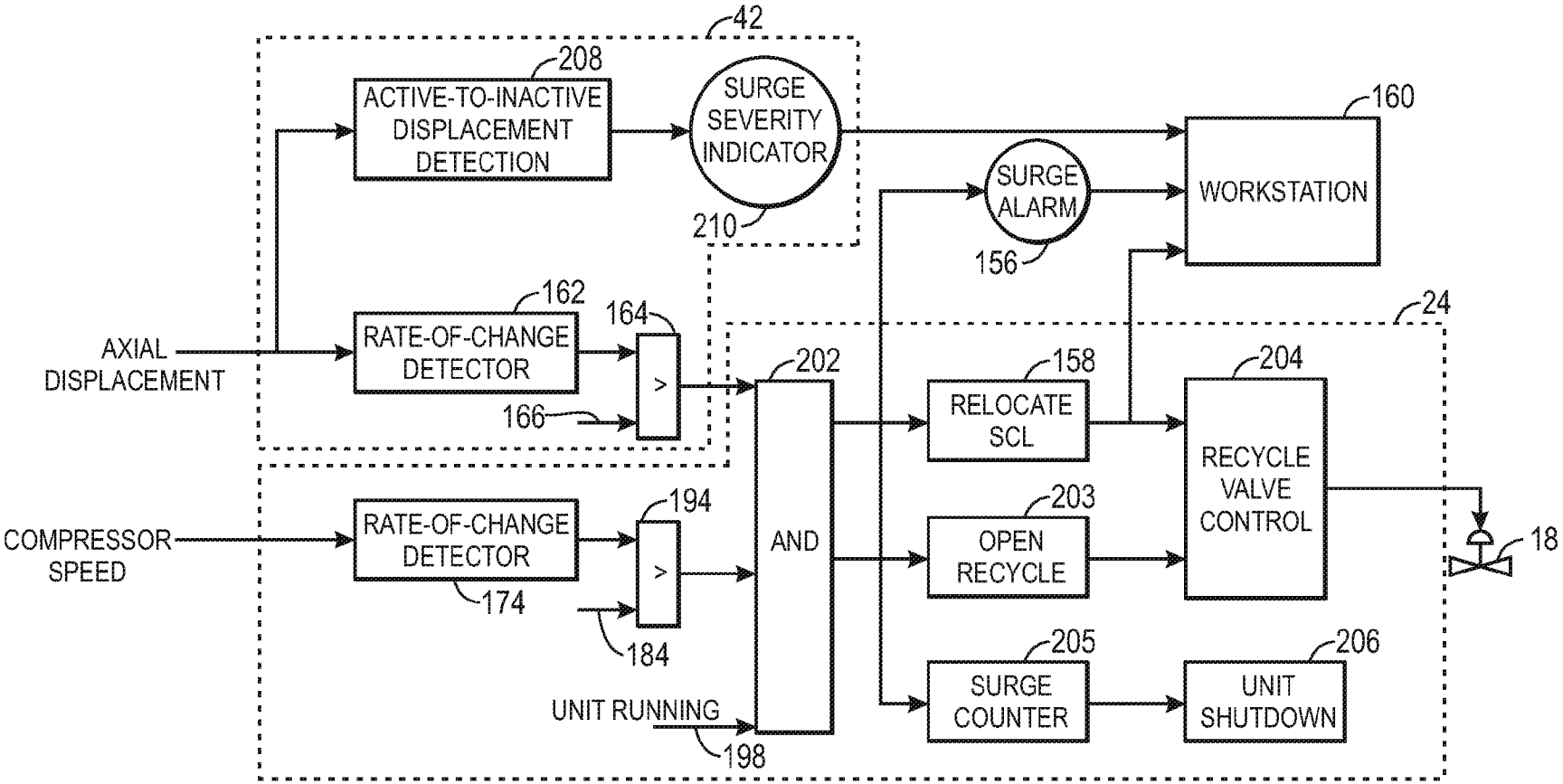
FIG. 9 is a block diagram of an embodiment of methodology for surge detection utilizing axial displacement and rotating signals, applicable to the compression system of FIG. 1, in accordance with an embodiment of the present technique.
Figure 10:
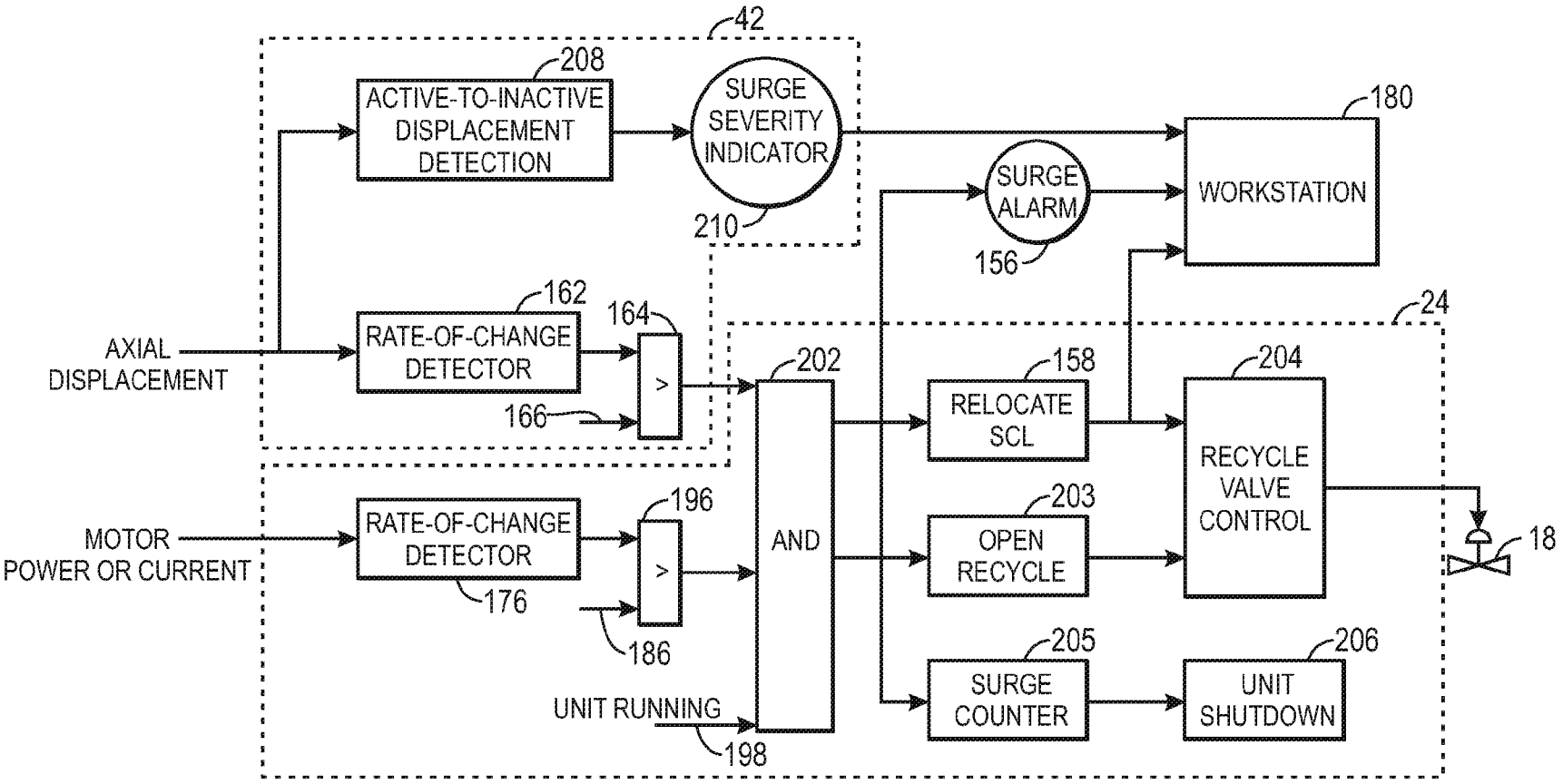
FIG. 10 is a block diagram of an embodiment of methodology for surge detection utilizing axial displacement and electric current or motor power of the electric motor driving the compressor, applicable to the compression system of FIG. 1, in accordance with an embodiment of the present technique.

The operation of the vibration monitor 42 and the control system 24 with regards to a rotating stall may be further described below with respect to FIG. 6. FIG. 6 illustrates a block diagram of the vibration monitor 42 as well as the control system 24, of FIG. 1. The vibration monitor 42 may, for example, receive inputs along measurement line 48 and 50 that may be utilized to indicate a rotating stall or incipient surge in the compressor 12. Measurement lines 48 and 50 may transmit radial vibration measurement signals to a filter 126 and a filter 128 in the vibration monitor 42. Filter 128 provides a tracking filter for the radial vibration signals at the rotating frequency of the compressor shaft 43. That is, vibration monitor 42 also receives measurement of the rotating frequency of the shaft 43 and calculates the magnitude of the radial vibration occurring at the rotating frequency by filtering out all other frequencies. The magnitude occurring at the rotating frequency is usually referred to as synchronous or 1× magnitude.

During normal operation, the 1× magnitude is the dominant magnitude in the vibration frequency spectrum. That is, when the radial vibration signal is broken down into a summation of its component signals at various frequencies, the highest amplitude normally corresponds to the rotating frequency of the shaft 43. This is because rotation of the shaft 43 typically provides the dominant forcing function on the shaft 43. Abnormal operation, resulting from forcing functions other than shaft 43 rotation, may contribute to significant amplitudes appearing at frequencies other than the rotating frequency. Rotating stall and incipient surge are examples of such forcing functions. Rotating stall is characterized by stall cells, which may be pockets of relatively stagnant gas, rotating around the compressor 12 annulus in a direction opposite to the shaft 43 rotation. Such behavior causes unbalanced forces on the shaft 43, which may result in significant component of radial vibration signals appearing at frequencies below the rotating frequency. These components are referred to as subsynchronous vibration. Incipient surge, which may be characterized as pressure and flow pulsations due to approaching surge, also may manifest itself through subsynchronous vibrations. Typical frequencies at which rotating stall and incipient surge may appear are approximately 0.05 to 0.9 times the rotating frequency. Thus, a typical minimum operating rotating speed of the compressor 12 is approximately 3000 rpm, which translates into possible rotating stall and incipient surge frequencies of approximately 2.5 to 45 Hz. This range of rotating stall and incipient surge frequencies may be monitored as appearance of significant radial vibration signal components within this frequency range may be indicative of rotating stall or incipient surge.

The filter 126 may be, for example, a bandpass filter that may aid in the determination of rotating stall and incipient surge in the compressor 12 by filtering the radial vibration measurements from measurement lines 48 and 50 for likely ranges of rotating stall and incipient surge frequencies (e.g. subsynchronous peaks). Filter 126, for example, may also be a tracking filter in that the frequency range that is passed through the filter 126 may be implemented as a function of the rotational frequency, (e.g., between approximately 0.05× and 0.9×, where X signifies rotational frequency). In addition, in the case where there are other frequencies of the rotor system that may cause other subsynchronous frequencies such as rubs and looseness (e.g., approximately 0.5×) and fluid induced instabilities (e.g., approximately 0.45×), this may be excluded from the subsynchronous amplitudes. Peak-to-peak detector 130 calculates peak-to-peak amplitude of the waveform resulting from operation of filter 126.

Filter 128 may likewise be a tracking filter that filters the radial vibration measurements from measurement lines 48 and 50 for the signal component corresponding to the rotation speed of the compressor 12. Peak-to-peak detector 132 calculates the peak-to-peak amplitude of the waveform resulting from operation of filter 128. Divider circuit 134 calculates a percentage based on the synchronous signal (i.e., output of detector 132) and the non-synchronous signal (i.e., output of the detector 130). In addition to, or in place of the divider circuit 134, comparative reference to a simple amplitude setpoint may be made. For example, this simple amplitude setpoint may be approximately 0.2 mil peak-to-peak. The setpoint and/or the resulting percentage value is compared against a baseline threshold value 136 in comparator circuit 138. The threshold value 136 may, for example, be received from storage such as a memory circuit, which may, for example, reside in the control system 24 or vibration monitor 42. This threshold value 136 may be calculated, for example, as a running average. If the percentage value of the non-synchronous signal relative to synchronous signal is higher than the threshold value 136, the compressor 12 may be operating in the rotating stall or incipient surge region and thus the comparator circuit 138 issues a signal to the control system 24 indicating likely rotating stall or incipient surge. If, however, the percentage from divider circuit 134 fails to exceed the threshold value 136, then no stall indication signal 140 is generated for transmission to the control system 24. For example, if non-synchronous waveform has a peak-to-peak amplitude that is 60% of the synchronous waveform and the threshold is set to 50%, the output of the comparator circuit 138 will be set to TRUE, indicating a likelihood of rotating stall or incipient surge. Otherwise, the signal from comparator 138 will be FALSE. Alternatively, output of detector 132 may be compared to an absolute vibration amplitude value, eliminating the need for calculating the value of non-synchronous vibration as percentage of synchronous. The threshold in comparator circuit 114 may be set to, for example, approximately 1 mil.

The control system 24 may include one or more processors 142, for example, one or more "general-purpose" microprocessors, one or more special-purpose microprocessors and/or ASICS, or some combination of such processing components. The processor 142 may, for example, receive thermodynamic signals 144 and may calculate the distance from an operating point 78 of the compressor 12 to the SLL 68, which may be represented by output value 146. The control system 24 may also include memory which, for example, may store instructions or data to be processed by the one or more processors of the control system 24, such as generating and updating of the Surge Limit and Control lines 68 and 70 of a compressor 12. Furthermore, a threshold value 148 may be overwritten, (e.g. updated), for example, by the control system 24 based upon the detection of an actual rotating stall condition so that the threshold value 148 may accurately reflect any rotating stalls actually detected for future prevention of further stall incidents automatically.

As described above, the comparator 138 may determine the occurrence of a rotating stall or incipient surge and may transmit an indication signal 140 corresponding to the rotating stall or incipient surge to the control system 24. The control system 24 may receive this stall indication signal 140 and may respond to the stall indication signal 140 if, for example, compressor 12 is operating in a region 86 of the compressor map 84, where rotating stall or incipient surge condition is likely to occur. The region 86 of likely rotating stall and/or incipient may be delineated by minimum and maximum rotational speeds of the compressor 12, the proximity to the Surge Control Line 70, and other parameters, such as compressor 12 discharge pressure and compressor 12 flow via comparator 150, which may generate an enable signal 152. The enable signal 152 is generated and sent to an AND gate 154, along with the signal 140 from the vibration monitor 42. If the enable signal 152 and the signal 140 are TRUE, control system 24 may initiate several actions. For example, control system 24 may issue an alarm 156 for operating personnel, indicating likely rotating stall or incipient surge in the compressor 12. Control system 24 may also counteract rotating stall and/or incipient surge by increasing the margin between the SLL 68 and SCL 70, illustrated by element 158, thereby causing the recycle valve 18 to open, thus moving the operating point 78 away from the rotating stall and/or incipient region 86. Additionally, the control system 24 may transmit the coordinates of the region where rotating stall or incipient surge has occurred to a workstation 160 for storage and/or display.

The workstation 160 may comprise hardware elements (including circuitry), software elements (including computer code stored on a computer-readable medium) or a combination of both hardware and software elements. The workstation 160 may be, for example, a desktop computer, a portable computer, such as a laptop, a notebook, or a tablet computer, a server, or any other type of computing device. Accordingly, the workstation 160 may include one or more processors, for example, one or more "general-purpose" microprocessors, one or more special-purpose microprocessors and/or ASICS, or some combination of such processing components. The workstation 160 may also include memory, which, for example, may store instructions or data to be processed by the one or more processors such as firmware for operation of the workstation 160, i.e., basic input/output instructions or operating system instructions, and/or various programs, applications, or routines executable on the workstation 160. The workstation 160 may further include a display for displaying one or more images relating to the operation of the various programs of the workstation 160 and input structures, which may allow a user to interface and/or control the workstation 160. Additionally, the workstation 160 may include hardware and/or computer code storable in the memory of the workstation 160 and executable by the processor for generation and updating of a compressor 12 performance map 66 based on signals transmitted from the control system 24.

As mentioned previously, the control system 24 may also attempt to correct the stall in the compressor 12 when the output of the AND block 110 is true in step 112 of FIG. 5. For example, the recycle valve 18 may be opened to change the pressure inside of the compressor 12, which may eliminate the rotating stall conditions in the compressor 12, and alarm 156 may be activated based upon rotating stall and/or incipient surge detection by the control system 24. This alarm 156 may be activated concurrently with the opening of the recycle valve 18, or it may be activated prior to or subsequent to the opening of the recycle valve 18. Additionally, the alarm 156 may be activated, for example, instead of opening the recycle valve 18. Furthermore, as noted above, the control system 24 may update the location of the SCL 70 in block 116 to prevent the operating point 78 of the compressor 12 from entering the rotating stall region 86, as shown in FIG. 4.

As the compressor 12 operates, (e.g., follows one of the operational curves 72, 74, or 76 that represent the various operational ranges of the compressor 12 in FIG. 3), if a rotating stall event is encountered, leading to the generation of a rotating stall indication signal 140, the stall event 80 is noted and an indication of that stall event 80 is placed onto the map 66. Furthermore, as a result of this rotating stall event 80, the SCL 70 is moved from its original location, to a new location 94 to the right of the stall event 80. The SCL 70 may thus define the minimum allowable steady-state flow through the compressor 12, (e.g., a new flow limit), such that the operation of the compressor 12 along the operational curves 72, 74, and 76 will be curtailed as the compressor 12 approaches the new location 94 of the SCL 70 along any of the operational curves 72, 74, and 76, to aid in the prevention of a rotating stall event 80. However, as previously noted, rotating stall events 80 may be absent prior to reaching the actual surge limit. Therefore, control system 24 may also detect and respond to actual surge events in order to minimize and/or prevent process disruption and potential compressor 12 damage.

Accordingly, FIGS. 7, 8, 9, and 10, illustrate the control system 24 as operating to detect surge events, (e.g., surge in the compressor 12). Surge can be described as large and self-sustaining pressure and flow oscillations (i.e., unstable behavior) in the compressor 12, resulting from the interaction between the compressor 12 characteristics and those of the surrounding process or system. Surge cycle is characterized by a rapid decrease in the flow through the compressor 12. For example flow can lose more than 50% of its original value within approximately 100 msec, while under normal circumstances (e.g., to the right of the SLL 68 on the compressor map 66) such change may take several seconds. Compressor 12 discharge pressure may drop simultaneously (or within several tenths of a second)) with flow, while suction pressure may rise. Just as with the flow, the rate of change of the suction and discharge pressures is typically much more rapid during surge than during normal operation, typically 10-20% per second or more, while normally the rate of change is less than 1-2% per second. Rapid change in the pressure and flow across the compressor 12 may cause large changes in the axial forces on the compressor shaft 43. These changes may translate into rapid changes in the axial displacement, measured by the monitoring system.

The rates-of-change of various compressor parameters may be difficult to measure accurately due to significant noise present in the signals and placement of the pressure and flow sensors 40 far away from the compressor 12, which tends to significantly dampen the observed signals. In addition, signal failures may result in nuisance detection. Therefore, it may be beneficial to detect surge by basing detection on a combination of signals, rather than one signal. Accordingly, surge detection methods of FIGS. 7-10 include monitoring of the rates of change of both thermodynamic parameters and the mechanical parameters to provide for surge detection methods based on both types of measurements.

In addition, the measurement of axial displacement may be analyzed to provide an indication of the severity of the surge cycle. Classifying the severity of a surge cycle may facilitate understanding of any subsequent decrease in compressor efficiency and required maintenance schedule. Typically, the net force, resulting from the pressure differential across the compressor 12 tends to act on the shaft 43 in the direction opposite to the gas flow through the compressor 12, (e.g., the force direction is from discharge to suction). The face of the thrust bearing 44, which counteracts this force, is referred to as the active thrust bearing face, and the force direction toward this bearing 44 face is termed active direction. The other thrust bearing face is termed inactive. During normal operation the shaft 43 may be displaced toward the active bearing face from its neutral or non-running position due to the forces resulting from the compression of the gas. During a fully developed surge cycle the flow through the compressor 12 may be reversed, resulting in the reversal of the forces acting on the shaft 43, and consequently affecting the displacement of the shaft 43. In order to determine the severity of the surge cycle the change in the axial displacement of the shaft 43 during a surge cycle may be compared to the thrust bearing 44 clearance. For example, the change in the axial position may be calculated as a percentage of the thrust bearing 44 clearance. If the calculated percentage exceeds the displacement from the active direction to the inactive, then the surge may be classified as severe, with potential damage to the compressor 12.

To this end, FIGS. 7, 8, 9, and 10 illustrate methodology that may be employed in detecting a surge cycle, as well as the number of consecutive surge cycles and their severity. The vibration monitor 42 may receive the measurements of axial displacement from the thrust bearing 44 transmitted along measurement line 48. These axial displacement measurements may be transmitted to a rate of change detector (RCD) 162 in the vibration monitor 42. The RCD 162 may, for example, be an ASIC, or detection circuitry that may measure a change in the value of the received value, (e.g. the axial displacement measurements), over time. For example, the RCD 162 may measure the percent change of the axial displacement measurements per second, per millisecond, or per some other time frame.

The output of the RCD 162 is thus, for example, a value expressed in units per time. This output may be compared in a comparator 164 with a threshold value 166. The comparator 164 may, for example, determine if the output of the RCD 162 exceeds the threshold value 166, which may, for example, be received from storage such as a memory circuit, which may, for example, reside in the control system 24. Furthermore, the threshold value 166 may be overwritten, (e.g. updated), for example, by the control system 24 based upon the detection of a surge event so that the threshold value 166 may accurately reflect any surge events detected for future detection of surge.

If the output of the RCD 162 exceeds the threshold value 166, then an enable signal is generated. Additionally, while the vibration monitor 42 is determining if a surge indication signal is to be generated, the control system 24 may perform substantially the same operation with respect to the thermodynamic parameters of the compressor 12. For example, the control system 24 may receive measurements of compressor 12 flow from the flow measurement device 38, measurements of suction pressure and temperature from the suction pressure measurement device 30 and the suction temperature measurement device 34, and/or measurements of discharge pressure and temperature from the discharge pressure measurement device 32 and the discharge temperature measurement device 36. Additionally, measurements may come from alternate sources such as the drive shaft 43 rotation speed, or, in case of an electromotor driven compressor, motor current or power. As illustrated in FIGS. 7-10, each of the measurements of compressor 12 flow, the measurements of suction pressure, and the measurements of discharge pressure may be passed to a respective RCD 168, 170, 172, 174, or 176 such that an output corresponding to each of rates of change for the compressor flow, the suction pressure, and the discharge pressure may be compared to a respective threshold value 178, 180, 182, 184, or 186 in a respective comparator 188, 190, 192, 194, or 196. The detection is based on several combinations of signals exceeding their respective thresholds, shown in FIGS. 7, 8, 9, and 10. The control system 24 may use one or several of these combinations to detect surge. The combinations are as follows: (1) axial displacement and flow, shown in FIG. 7; (2) axial displacement and either suction or discharge pressure signals shown in FIG. 8 (via or gate 199); (3) axial displacement and compressor speed shown in FIG. 9; (4) axial displacement and motor current or power shown in FIG. 10.

If the rate of change of axial displacement and the rate of change of the compressor flow exceed their respective threshold values 166 and 178, and the compressor 12 running indication 198 is TRUE, an enable signal 200 is generated by the AND gate 202. This surge detection signal 200 may be transmitted to a processor of the control system 24. The processor of the control system 24 may perform several actions in order to protect compressor 12 from surge, prevent future occurrences of surge, and inform operations personnel of the surge event and its severity. The control system 24 may attempt to counteract the surge condition in the compressor 12 by causing the recycle valve 18 to be opened in block 203 via a recycle valve control 204 to change the pressure and flow inside of the compressor 12, which may eliminate the surge conditions in the compressor 12. Additionally, an alarm 156 may be activated based upon the receipt of the surge indication signal 200. If a continuous surge is detected 205, (e.g. two, three, or more surges regardless of the recycle valve 18 being opened), the processor may generate a unit trip signal that may cause the compressor train 12 to shut down 206. Furthermore, as noted above, the control system 24 may also update the threshold values 166 and 178-186 to reflect, for example, a new surge control line location 94 that may govern the operational parameters of the compressor 12, specifically, how close the operation of the compressor 12 may come to the surge control line 70 during operation, as described with respect to FIG. 3. In addition, vibration monitor 42 may detect whether there has been a full force reversal 208 on the shaft 43 and provide an indication 210 of the severity of surge, based on this detection, to the workstation 160.

Additionally, for example, a processor in the control system 24 may update the compressor map 66 based on the surge indication signal 200 in real-time by logging a surge event on the compressor map 66, as well as by adjusting, surge limit line 68 and a surge control line 70. This real-time updated data may, for example, be transmitted to the workstation 160 for storage and/or display. The surge point or region may be placed on the compressor map FIG. 3, in the same manner as the stall region, described previously.

It should be recognized that the present techniques have been described in conjunction with circuitry (e.g., hardware). However, these techniques may alternatively be performed by computer code storable in memory. For example, the functionality described above with respect the vibration monitor 42 may be performed by hardware or software, (e.g. computer code), stored on a memory in the monitor system 36. Further, the control system 24 may exist solely as one or more processors with associated memory that stores instructions, (e.g. computer code or software), for performing the various techniques outlined above with respect to each of the monitor system 36 and/or the control system 24, respectively.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A system, comprising:

a monitor system configured to receive measurements indicative of operational, thermodynamic, and mechanical characteristics of a compressor, wherein the mechanical characteristics comprise vibration characteristics of a component of the compressor, and to generate a compressor stability indication based on the thermodynamic and mechanical characteristics; and a control system configured to receive the compressor stability indication and to generate a response to the compressor stability indication.

2. The system of claim 1, wherein the thermodynamic characteristics comprise at least one of a fluid temperature, a fluid pressure, a fluid flow characteristic, or a combination thereof, of the compressor or a system having the compressor.

3. The system of claim 1, wherein the vibration characteristics comprise a frequency of vibration of the component of the compressor and wherein the mechanical characteristics comprise at least one of the frequency of vibration, a frequency of displacement, or a combination thereof.

4. The system of claim 3, wherein the mechanical characteristics comprise the position of a drive shaft of the compressor and the thermodynamic characteristics comprise calculations resulting from measurements of the compressor.

5. The system of claim 1, wherein the response to the compressor stability indication is generated automatically by the control system in real-time.

6. The system of claim 1, wherein the compressor stability indication comprises a compressor stall event.

7. The system of claim 6, wherein the response of the control system comprises an updating control action configured to update a compressor performance map to include a representation of the compressor stall event.

8. The system of claim 1, wherein the compressor stability indication comprises a compressor surge event.

9. The system of claim 8, wherein the response of the control system comprises an updating control action configured to update a compressor performance map to include a representation of the compressor surge event.

10. A system, comprising:

a compressor;

a thermodynamic and mechanical monitor system configured to receive measurements indicative of a thermodynamic characteristic and a mechanical characteristic of the compressor and to generate an indication of a surge event and a stall event in the compressor based on the thermodynamic and mechanical characteristics, wherein the mechanical characteristic comprises a subsynchronous vibration frequency of the compressor; and a control system configured to receive the indication of surge and stall events and to generate a response to the indication of surge and stall events.

11. The system of claim 10, comprising a filter configured to filter the mechanical characteristic of the compressor to isolate the subsynchronous vibration frequency of the compressor.

12. The system of claim 11, comprising a comparator configured to determine if the subsynchronous vibration frequency of the compressor exceeds a threshold and to generate the indication of the stall event when the subsynchronous vibration frequency of the compressor exceeds the threshold.

13. The system of claim 12, wherein the response of the control system comprises an updating control action configured to update a compressor performance map to create a surge control line defining the minimum allowable steady-state flow through the compressor.

14. The system of claim 10, comprising a rate of change detector configured to generate a percentage rate of change of the mechanical characteristic of the compressor related to thrust bearing position or other displacement measurements.

15. The system of claim 14, comprising a comparator configured to determine if the percentage rate of change of the mechanical characteristic of the compressor exceeds a first threshold and to generate the indication of the surge event when the the percentage rate of change of the mechanical characteristic of the compressor exceeds the first threshold and the thermodynamic characteristic of the compressor exceeds a second threshold.

16. The system of claim 15, wherein the response of the control system comprises an updating control action configured to update a compressor performance map to create a surge control line defining the minimum allowable steady-state flow through the gas turbine compressor.

17. A system, comprising:

a compressor; and a control system comprising a processor and associated memory, wherein the control system is configured to receive feedback comprising a thermodynamic characteristic and a mechanical characteristic of the compressor, wherein the mechanical characteristic of the compressor is related to a vibration characteristic of at least one component of the compressor, and the control system is configured to generate an indication of a surge event or a stall event in the compressor based on the feedback.

18. The system of claim 17, wherein the associated memory comprises at least one threshold value updated in response to the indication of a surge event.

19. The system of claim 17, wherein the associated memory comprises at least one threshold value updated in response to the indication of a stall event.

20. The system of claim 17, comprising a workstation comprising a display for display of a compressor performance map, wherein the control system generates a signal to update the compressor performance map in real-time upon generation of the indication of the surge event or the stall event in the compressor.

* * * * *